US006095350A

United States Patent [19]

Sauer et al.

[11] Patent Number: 6,095,350

[45] Date of Patent: Aug. 1, 2000

[54] NON-METALLIC WEAR PLATE FOR RAILROAD CAR COUPLERS AND METHOD OF USE

[75] Inventors: Robert J. Sauer, Mullica Hill, N.J.; John W. Rudibaugh, West Chester, Pa.

[73] Assignee: Pennsy Corporation, West Chester, Pa.

[21] Appl. No.: 09/108,457

[22] Filed: Jul. 1, 1998

[51] Int. Cl.[7] ..... B61G 7/00

[52] U.S. Cl. ..... 213/50; 213/61; 213/19; 213/20

[58] Field of Search ..... 213/19, 20, 21, 213/50, 54, 61, 60

[56] References Cited

U.S. PATENT DOCUMENTS 4,238,039 12/1980 Cooper et al. ..... 213/61
4,334,625 6/1982 Kleykamp ..... 213/61
5,174,457 12/1992 Carroll et al. ..... 213/61
5,598,936 2/1997 Murphy ..... 213/61

*Primary Examiner*—Mark T. Le
*Attorney, Agent, or Firm*—John F. A. Earley; John F. A. Earley, III; Harding, Earley, Follmer & Frailey

[57] ABSTRACT

A non-metallic wear plate assembly for railroad car couplers comprises a wear plate of ultra-high molecular weight polyethylene having an upper surface with side edges and a middle portion therebetween, the upper surface of the wear plate sloping downwardly from the side edges to the middle portion, and a number of counter-bored holes in the wear plate with a larger diameter and a smaller diameter with the larger diameter of the counter-bored holes facing up, the wear plate being mounted on a steel filler plate by weld washers which are positioned in the holes and are welded to the filler plate, with optional weld washer plugs being positioned in the holes above the weld washers and flush with the upper surface of the wear plate. A method of using the non-metallic wear plate for railroad car couplers to center a coupler and protect it against wear.

6 Claims, 4 Drawing Sheets

NON-METALLIC WEAR PLATE FOR RAILROAD CAR COUPLERS AND METHOD OF USE

BACKGROUND OF THE INVENTION

1. Technical Field

The present invention relates to wear plates for railroad car couplers, and more particularly concerns a non-metallic wear plate made of ultra-high molecular weight polyethylene for railroad car couplers and used in place of the steel wear plates of the prior art.

2. Background of the Prior Art

Presently, sliding a railroad car coupler over a typical steel wear plate requires such a large human effort that it has been found to be a safety problem. The large effort results sometimes in strained backs, and other injuries. For proper coupling, a man has to shove the coupler into alignment from the side, and can require approximately 121 lbs. of effort to move the coupler into alignment with another coupler extending from the railroad car to which coupling is to be made.

If the coupler misses the other coupler, bypass occurs and causes damage to the railroad cars. In some cases, the coupling procedure includes a humping operation off a hill in a railroad yard. In other cases, a switching engine pushes the railroad car to accomplish the coupling.

Low friction between the coupler and the wear plate of the car to be coupled eases the force required to make the coupling.

With steel wear plates, it is conventional to put lubricants on the steel plates to lessen the force required to center the coupler. Typically the lubricant lessens the force required from 121 lbs. of force before lubrication to less than 84 lbs. of force after lubrication. But the lubricant wears out quickly and does not solve the problem. Sometimes the conventional wear plates are over lubricated and the coupler may slide out of position because the coating of the wear plate is too slippery.

BRIEF SUMMARY OF THE INVENTION

The present invention includes a non-metallic wear plate for railroad car couplers. The wear plate has a sloped upper surface that helps center the coupler if it is askew. Also, the present invention provides a wear plate with low friction so as to ease the burden of swinging it into place. The wear plate of this invention is attached by weld washers to the steel filler plate below it. The non-metallic wear plate of this invention for railroad car couplers is made of a ultra-high molecular weight plastic such as ultra-high molecular weight polyethylene. This provides a friction which is between that of a dry steel wear plate and a lubricated steel wear plate.

DETAILED DESCRIPTION OF THE DRAWINGS

Figure 1:
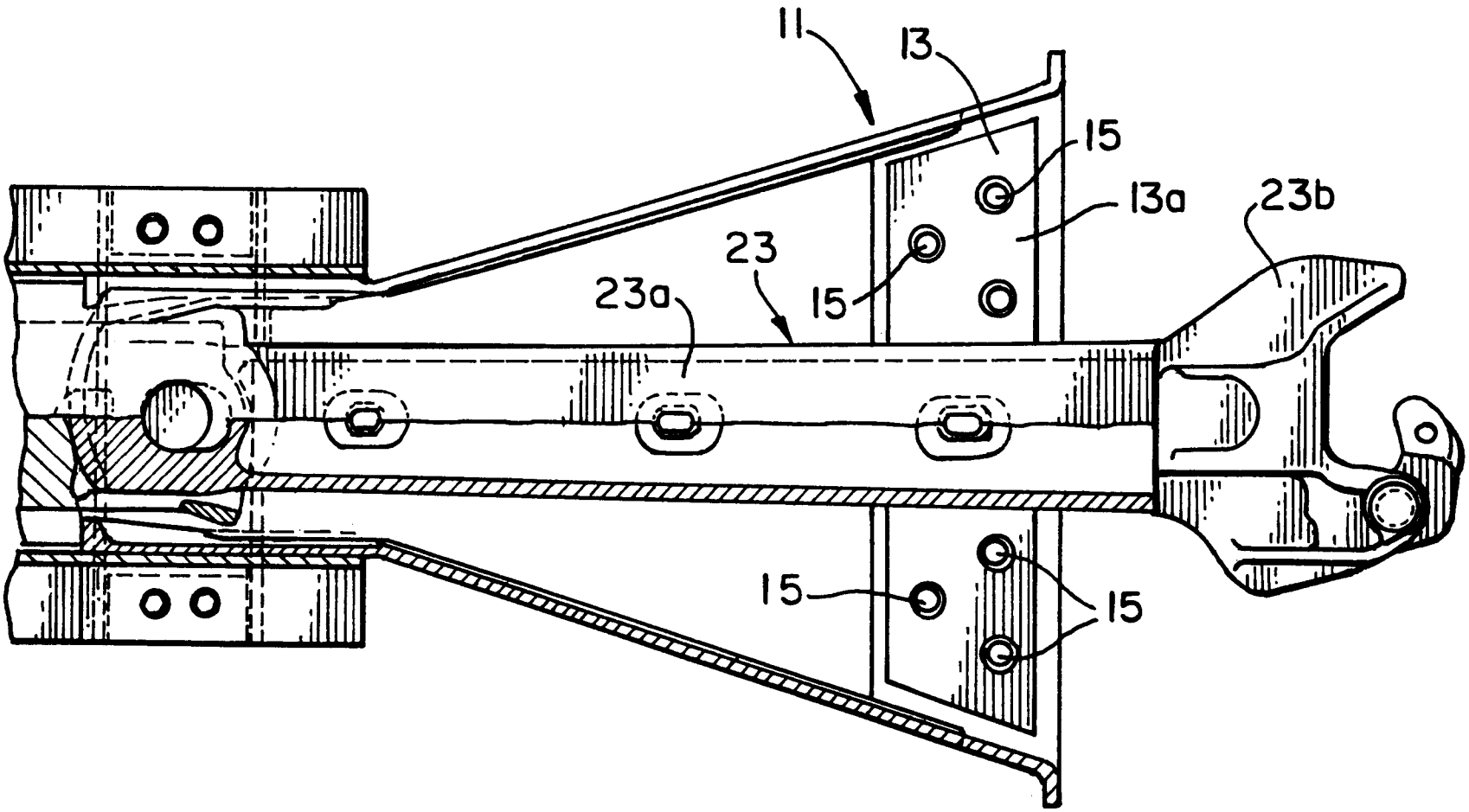
FIG. 1 is a view in top plan of a coupler and a non-metallic wear plate.
Figure 2:
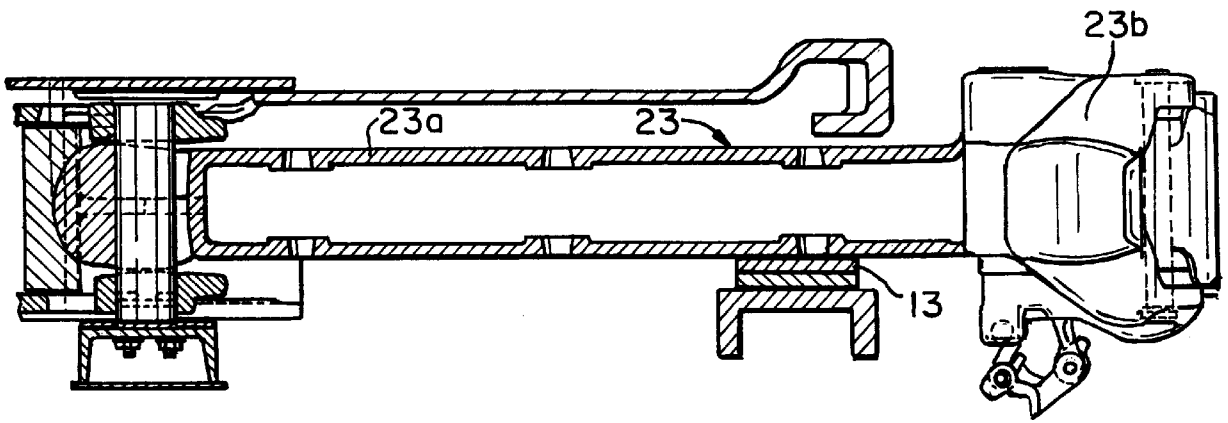
FIG. 2 is a view in verticle section and side elevation of the coupler and wear plate of FIG. 1.
Figure 3:
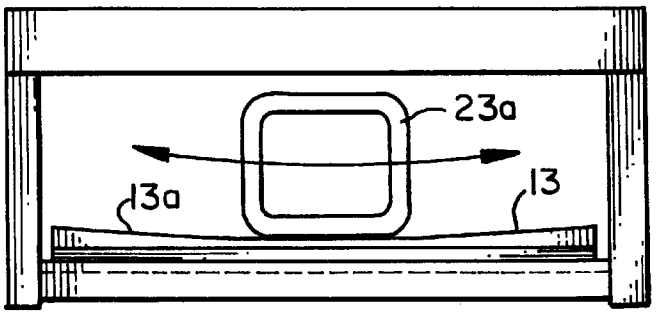
FIG. 3 is an end view of the coupler and wear plate of FIG. 1 with the coupler head removed.
Figure 5:
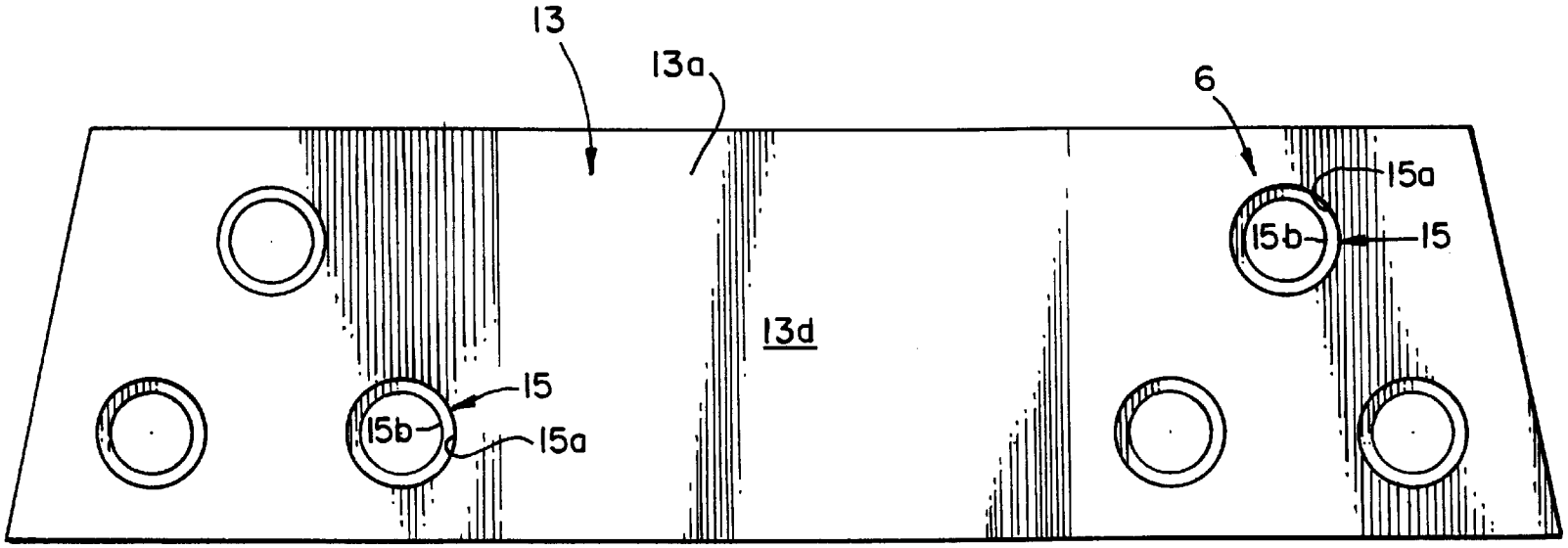
FIG. 5 is a top plan view of the non-metallic wear plate of FIG. 4.
Figure 4:
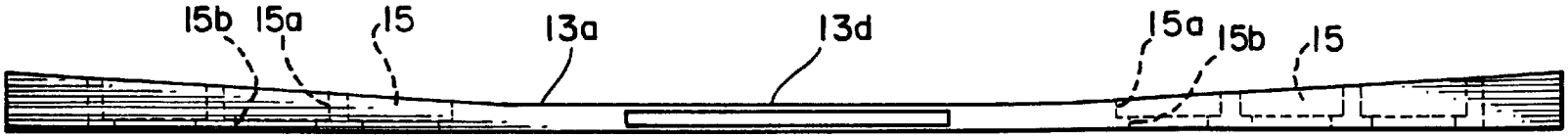
FIG. 4 is a view in front elevation of the non-metallic wear plate.
Figure 7:
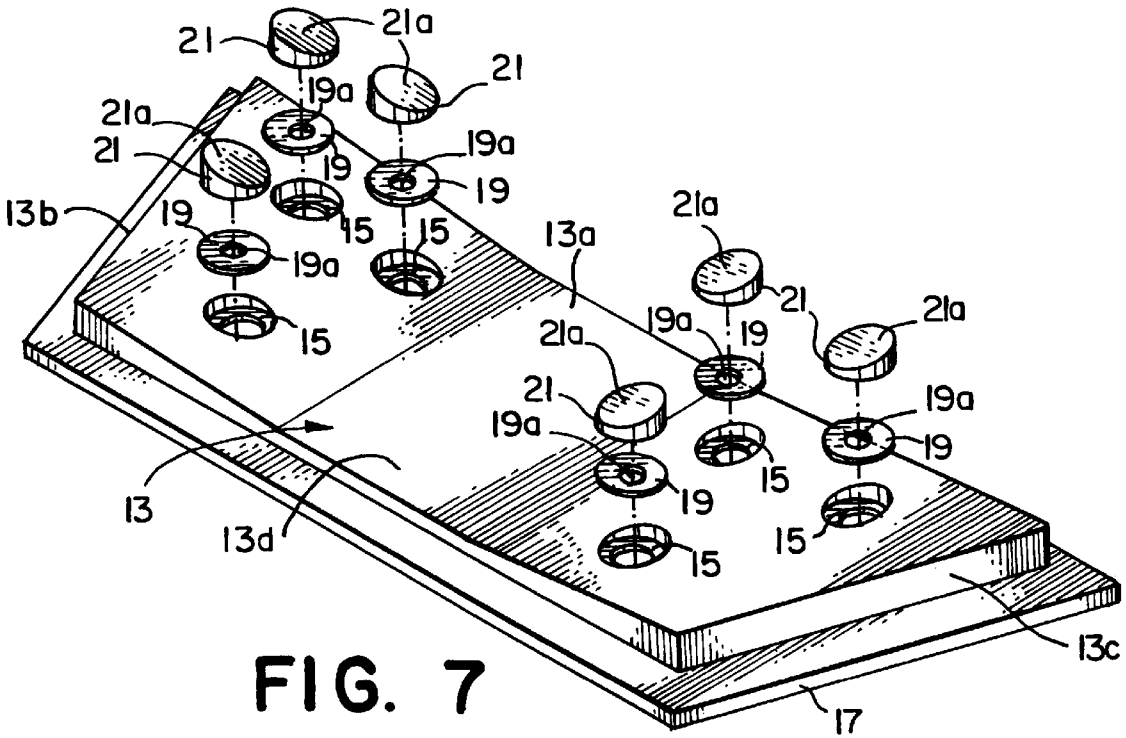
FIG. 7 is a perspective view of the non-metallic wear plate and shows an exploded view of the weld washers and optional weld washer plugs. The wear plate is sloped from its sides toward its middle portion, and the top surface of the plugs are sloped to be flush with the top surface of the wear plate.
Figure 6:
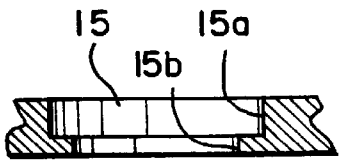
FIG. 6 is a view in section of the counter-bore hole indicated by the number 6 in FIG. 5.
Figure 8:
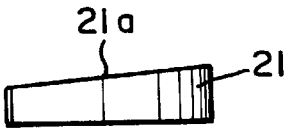
FIG. 8 is a side view in elevation of a weld plug and illustrates the slope of its top surface that enables its top surface to be flush with the top surface of the wear plate.

Turning now to the drawings, there is shown a non-metallic wear plate assembly 11 which includes a wear plate 13 made of ultra-high molecular weight polyethylene. Products made of such material may be obtained from Poly Hi Solidur, Inc., 2710 American Way, Fort Wayne, Ind. 46899-9086. The wear plate material is comprised of virgin UHMW PE and a strengthening additive and is offered as a shatter resistant alternative to sintered ceramics, with greater dimensional stability and wear resistance then other grades of UHMW PE.

Wear plate 13 has an upper surface 13*a* with side edges 13*b* and 13*c* and a middle portion 13*d* therebetween. The upper surface 13*a* of wear plate 13 slopes downwardly from the side edges 13*b*–13*c* to the middle portion 13*d*.

A number of counter-bored holes 15 are formed in the wear plate 13 with a larger diameter 15*a* and a smaller diameter 15*b*, with the larger diameter 15*a* of the counter-bored holes 15 facing up. Wear plate 13 is mounted on a steel filler plate 17 by welded washers 19 which are positioned in the holes 15 and are welded to the filler plate 17. Weld washers 19 are made of metal, preferrably carbon steel, so as to be weldable to the steel filler plate 17. Optional weld washer plugs 21 are positioned in holes 15 above the weld washers 19 and are sloped so as to be flush with the upper surface 13*a* of the wear plate 13. Plugs 21 are preferrably made of a UHMW plastic.

In operation, the method of using a non-metallic wear plate 13 to center a coupler 23 and protect it against wear, comprises the steps of providing a non-metallic wear plate 13 of ultra-high molecular weight polyethylene, with the wear plate 13 having an upper surface 13*a* with side edges 13*b*, 13*c* and a middle portion 13*d* therebetween, with the upper surface 13*a* of the wear plate 13 sloping downwardly from the side edges 13*b*, 13*c* to the middle portion 13*d*, and having a number of counter-bored holes 15 in the wear plate 13 with a larger diameter 15*a* and a smaller diameter 15*b* and with the larger diameter 15*a* of the counter-bored holes 15 facing up.

The method steps further include raising a coupler 23 having a shank 23*a* and a head 23*b* to clear an existing wear plate. The existing wear plate is removed, exposing a filler plate. Any existing filler plate is inspected for wear and cracks. If the filler plate is worn or cracked, it is replaced with a new filler plate 17 which is flat and free of weld, splatter, or other debris.

The non-metallic wear plate 13 is placed on the filler plate 17 with the larger diameter 15*a* of the counter-bored holes 15 facing up. The non-metallic wear plate 13 is lightly clamped to the filler plate 17, and a weld washer 19 having a small diameter hole 19*a* is placed in each counter-bored hole 15 of the wear plate 13 so that the small diameter hole 19*a* of each weld washer 19 rests on the filler plate 17. The small diameter hole 19*a* of each weld washer 19 is plug welded to the filler plate 17. All weld splatter and slag is removed from the non-metallic wear plate 13 and the weld washers 19. An optional weld washer plug 21 is inserted into hole 15 above the weld washer 19 so that the top surface 21*a* of the plug 21 is flush with the upper surface 13*a* of the non-metallic wear plate 13.

Then the shank 23*a* of the coupler 23 is placed on the wear plate 13. The non-metallic wear plate 13 provides continuous low friction between the wear plate 13 and the shank 23*a* of the coupler 23, and the slope of the wear plate 13 serves to center the coupler 23.

What is claimed is:

1. A non-metallic wear plate for railroad cars couplers comprising:

a wear plate of ultra-high molecular weight polyethylene, said plate having an upper surface with side edges and a middle portion therebetween, the upper surface of the wear plate sloping downwardly from the side edges to the middle portion, and a number of counter-bored holes in the wear plate with a larger diameter and a smaller diameter with the larger diameter of the counter-bored holes facing up.

2. A non-metallic wear plate assembly for railroad car couplers, comprising:

a wear plate of ultra-high molecular weight polyethylene, said plate having an upper surface with side edges and a middle portion therebetween, the upper surface of the wear plate sloping downwardly from the side edges to the middle portion, and a number of counter-bored holes in the wear plate with a larger diameter and a smaller diameter with the larger diameter of the counter-bored holes facing up, said wear plate being mounted on a steel filler plate by weld washers which are positioned in said holes and are welded to said filler plate.

3. The wear plate of claim 2, including:

weld washer plugs positioned in said holes above the weld washers and with an upper surface of the weld washer plugs being flush with the upper surface of the wear plate.

4. A method using a non-metallic wear plate to center a coupler and protect it against wear, comprising the steps of:

providing a wear plate of ultra-high molecular weight polyethylene, said wear plate having an upper surface with side edges and a middle portion therebetween, the upper surface of the wear plate sloping downwardly from the side edges to the middle portion, and a number of counter-bored holes in the wear plate with a larger diameter and a smaller diameter with the larger diameter of the counter-bored holes facing up, raising a coupler having a shank and a head to clear an existing wear plate, removing the existing wear plate, inspecting any filler plate which may have been below the wear plate for wear and cracks, replacing the filler plate if worn or cracked with a new filler plate which is flat and free of weld, splatter, or other debris, placing the non-metallic wear plate on the filler plate with the larger diameter of the counter-bored holes facing up, lightly clamping the non-metallic wear plate to the filler plate, placing a weld washer having a small diameter hole in each counter-bore hole of the wear plate so that the small diameter hole of each weld washer rests on the filler plate, plug welding the small diameter hole of each weld washer to the filler plate, and removing all weld splatter and slag from the non-metallic wear plate and weld washers.

5. The method of claim 4, including:

inserting a weld washer plug into the weld washer so that the top surface of the weld washer plug is flush with the upper surface of the non-metallic wear plate.

6. The method of claim 4, including:

placing a shank of the coupler on the wear plate, providing continuous low friction between the non-metallic wear plate and the shank of the coupler, and centering the coupler by contacting the slope of the wear plate and letting the coupler slide into place.

* * * * *